United States Patent [19]

Melenyzer

[11] Patent Number: 4,911,237

[45] Date of Patent: Mar. 27, 1990

[54] RUNNING TOOL FOR LINER HANGER

[75] Inventor: George J. Melenyzer, Humble, Tex.

[73] Assignee: Baker Hughes Incorporated, Houston, Tex.

[21] Appl. No.: 325,234

[22] Filed: Mar. 16, 1989

[51] Int. Cl.[4] ..... E21B 23/02

[52] U.S. Cl. ..... 166/208; 166/212

[58] Field of Search ..... 166/212, 208, 206, 216, 166/125, 181

[56] References Cited

U.S. PATENT DOCUMENTS

| | | | |
|---|---|---|---|
| 4,497,371 | 2/1985 | Lindsey, Jr. | 166/212 |
| 4,562,889 | 1/1986 | Braddick | 166/208 |
| 4,688,642 | 8/1987 | Baker | 166/216 |
| 4,834,185 | 5/1989 | Braddick | 166/208 |

*Primary Examiner*—Stephen J. Novosad
*Assistant Examiner*—Terry Lee Melius
*Attorney, Agent, or Firm*—Hubbard, Thurman, Turner & Tucker

[57] ABSTRACT

A tool for running in a liner hanger and a depending lining string comprises a tubular body having telescopically related inner and outer tubular units which are shearably interconnected for co-rotation. A plurality of downwardly projecting tongues are provided on the periphery of the outer tubular unit and respectively engage upwardly facing grooves provided in the liner hanger to impart rotation in either direction to the liner hanger. A downwardly extending mandrel secured to the inner tubular unit extends through the outer tubular unit and provides a mounting for the ring portion of a collet. The collet has spring biased arms mounting head portions which respectively engage in an annular groove provided in the liner hanger to secure the running tool to the liner hanger for run-in purposes. The collet is normally released from the running tool by a fluid pressure actuated piston mounted on the mandrel. In an emergency, the inner tubular unit may be shearably released from the outer tubular unit and moved downwardly with respect to the outer tubular unit, thus permitting the release of the collet heads from the liner hanger.

16 Claims, 5 Drawing Sheets

RUNNING TOOL FOR LINER HANGER

BACKGROUND OF THE INVENTION

1. FIELD OF THE INVENTION

The invention relates to a running tool for effecting the run-in of a liner running tool and a depending liner in the bore of the casing of a subterranean well, and particularly to a running tool which is normally hydraulically released from the liner hanger.

2. SUMMARY OF THE PRIOR ART

It has been a common practice in the oil and gas well industry to run casings part way into a well bore and then suspend a smaller diameter liner string from the bottom portions of the casing to traverse the remaining portions of the well bore. This necessarily requires a liner hanger which can be appropriately engaged with the casing wall to suspend the depending liner string and which normally requires a running tool to effect the insertion of the liner hanger and the depending liner string.

It is highly desirable that the running tool be capable of effecting rotation of the liner hanger in either direction in order to free the liner string from any obstacles that it may encounter in the course of its passage through the bore of the casing and the bore of the uncased portion of the well. Many liner running tools have been proposed wherein the rotation of the running tool in a particular direction, accompanied by either a tension or a compression force effects the release of the running tool from the hanger and premature releases have been all too common in the industry.

Additionally, running tools for liner hangers have been proposed wherein the release of the liner is accomplished by a hydraulically actuated mechanism, but the failure of a seal or a valve involved in such mechanism completely prevents the release of the running tool, requiring that the running tool liner hanger and depending liner string be removed from the well for the necessary repairs or adjustments.

The prior art has not provided a liner running tool which is capable of imparting rotation in either direction to the liner hanger for run-in purposes and which will impart such rotation when under either a compressive or a tensile stress without effecting the premature release of the running tool from the liner hanger. Additionally, the prior art has not provided a hydraulic release mechanism for a liner hanger which can, in an emergency, be mechanically actuated to effect the complete release of the running tool from the liner hanger.

SUMMARY OF THE INVENTION

The invention provides a running tool for a liner hanger and a depending liner string. The liner hanger is required to define within its bore an annular anchor groove for engagement by enlarged collet heads carried by the running tool. Additionally, the liner hanger is provided with a plurality of upwardly facing, peripherally spaced slots in its uppermost end for respective engagement with a plurality of downwardly projecting tongues carried by the running tool. In this manner, rotation of the liner hanger and its depending liner string can be effected in either direction by the running tool.

The running tool comprises a tubular assemblage including an inner tubular unit shearably connected to an outer tubular unit. The inner tubular unit is provided with threads for conventional securement to the end of a work string. The outer tubular unit defines a plurality of downwardly projecting, peripherally spaced tongues for engagement with aforementioned upwardly facing grooves in the liner hanger. A compressed spring urges such tongues to their lowermost position.

The inner tubular unit is provided with a central hollow mandrel which extends entirely through the outer tubular unit and terminates in an external abutment ring. A collet is provided having a ring portion mounted in surrounding relationship to a medial portion of the mandrel and having a plurality of peripherally spaced spring arms terminating in enlarged head portions which engage the aforementioned annular groove in the liner hanger and are secured in such position by the abutment ring to assure the axial connection of the running tool to the liner hanger. Mounting sleeves for the collet ring portion also define an annular fluid pressure chamber surrounding the mandrel and within which an annular piston is mounted and actuated by fluid pressure to exert an upward force against the ring portion of the collet. Such ring portion is shearably secured in the run-in position wherein the enlarged collet heads are in abutment with the abutment ring carried by the mandrel.

Upon an increase in fluid pressure within the bore of the hollow mandrel, the shear pins holding the collet are sheared and the collet is moved upwardly to shift the enlarged head portions out of engagement with the abutment ring to permit such head portions to be cammed inwardly and released from the annular groove in the liner hanger. A body lock ring assemblage is provided intermediate the ring portion of the collet and the mandrel, which cooperates with wicker threads provided on the exterior of the mandrel to secure the collet in its axially shifted position so that once moved into an unlocked position relative to the liner hanger, the collet remains in such unlocked position.

The foregoing describes the normal hydraulic release operation of the running tool. If, due to an emergency condition, such hydraulic release mechanism is ineffective, the running tool may nevertheless be mechanically released from the liner hanger. This is accomplished by effecting a shearing of the connection between the inner and outer tubular units to permit downward movement of the inner tubular unit relative to the outer tubular unit. Such downward movement moves the abutment ring on the central mandrel away from the collet locking heads, permitting such locking heads to release from the annular groove within which they had been retained during run-in. Thus, the running tool embodying this invention may be either hydraulically released or, in an emergency, mechanically released by manipulation of the tubing string.

Further advantages of the invention will be readily apparent to those skilled in the art from the following detailed description, taken in conjunction with the annexed sheets of drawings on which is shown a preferred embodiment of the invention.

DESCRIPTION OF PREFERRED EMBODIMENT

Figure 1A:
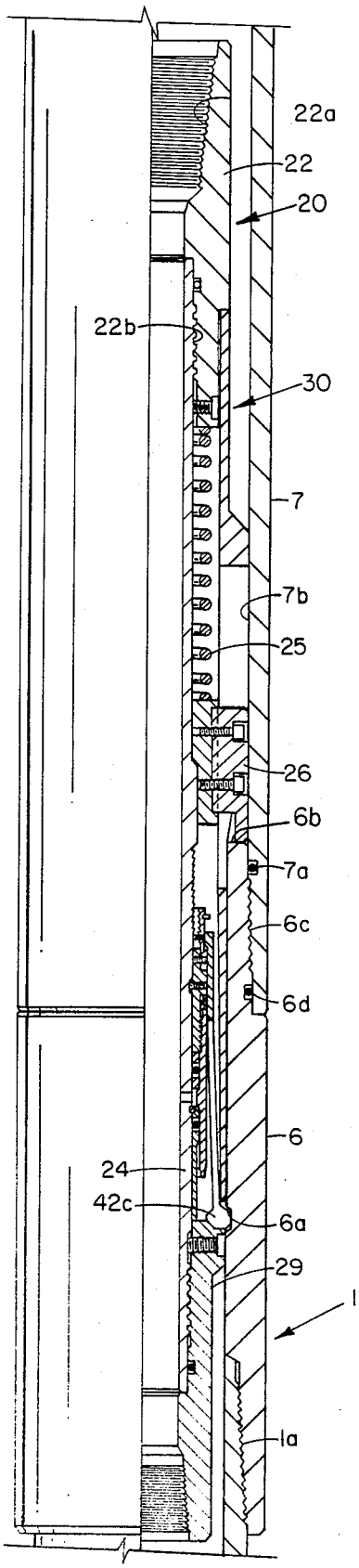
FIGS. 1A and 1B collectively represent a quarter sectional view of a running tool embodying this invention shown in a run-in position relative to a liner hanger.
Figure 1B:
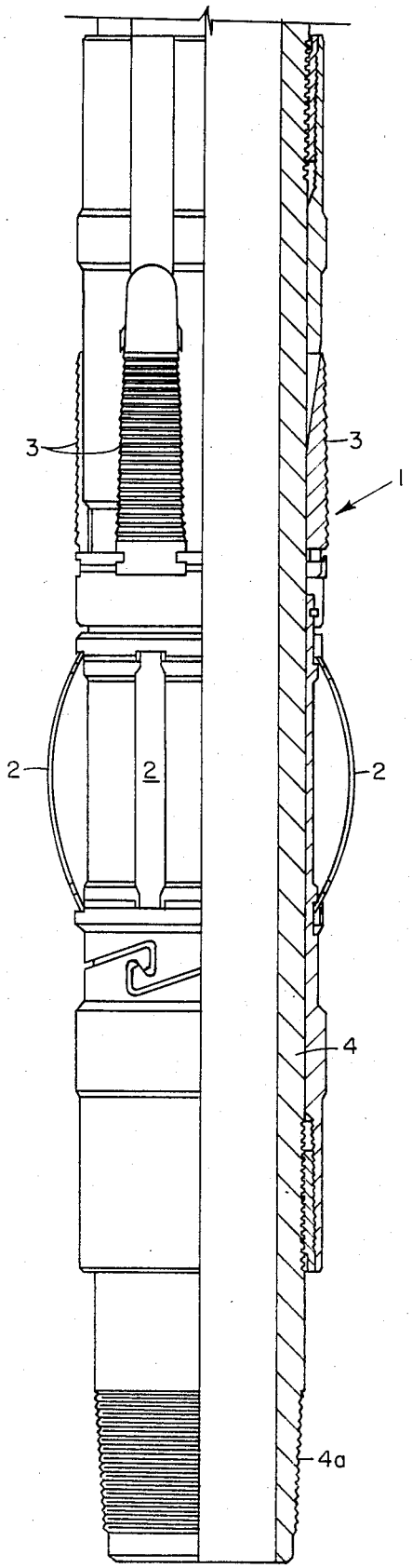

Referring first to FIGS. 1A and 1B, there is shown a conventional mechanically set liner hanger unit 1 having centralizing springs 2 and radially outwardly shiftable slips 3 which are moved into biting engagement with the wall of a casing (not shown). The liner hanger unit also incorporates a body member 4 having external threads 4a on its bottom end for securement to a liner string. Since the construction of the liner hanger unit is entirely conventional, further detailed description thereof is deemed unnecessary. Although such liner hanger unit is illustrated as being the mechanically set type, a hydraulically set unit could be equally well employed.

Secured to the top end of the liner hanger unit 1 by external threads 1a is a coupling sleeve 6 by which a running tool 10 embodying this invention is connected to the liner hanger to impart both rotational and axial movements to the liner hanger 1. The coupling sleeve 6 defines an annular internal groove 6b. Its upper end is provided with a plurality of peripherally spaced, upwardly opening grooves or notches 6b. Both of these elements are specifically required on the liner hanger 1 for connection to the running tool 10 embodying this invention.

If desired, a seal bore extension sleeve 7 may be secured to external threads 6c provided on the top end of the liner hanger coupling sleeve 6 and sealed by O-rings 6d and 7a. This element defines a seal bore 7b which can be utilized with tools other than a running tool for effecting a sealed connection with the liner hanger 1 after the hanger is set and the running tool removed.

Figure 2A:
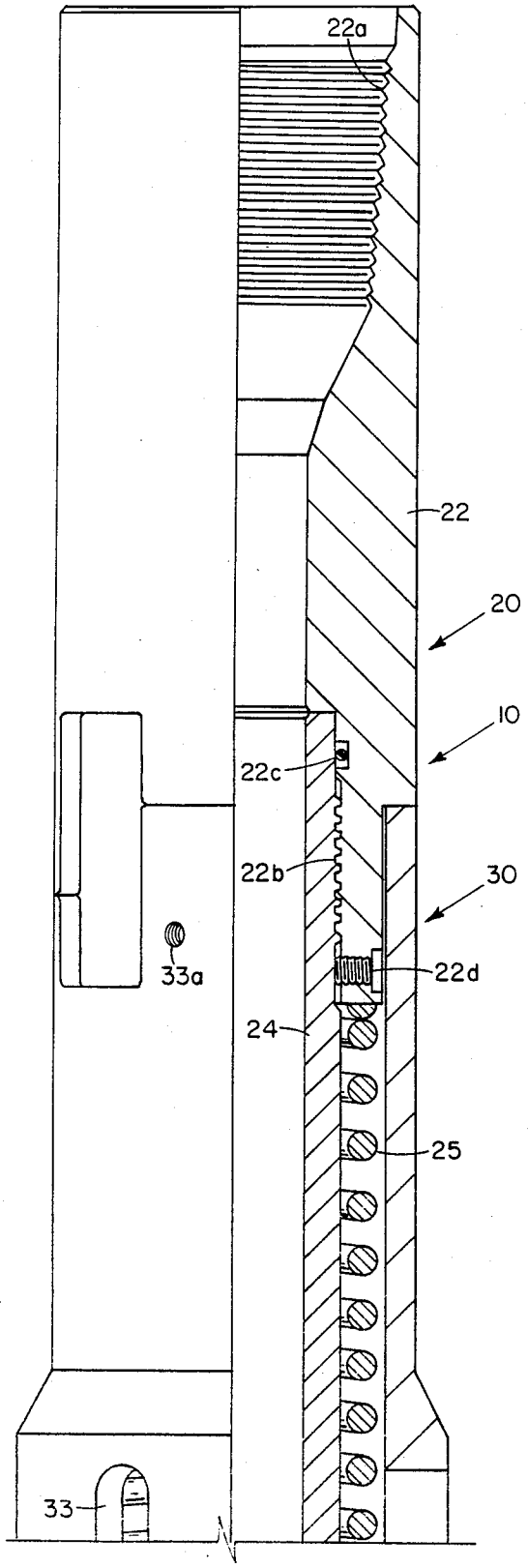
FIGS. 2A and 2B constitute enlarged views of only the running tool with its components in the run-in position.
Figure 2B:
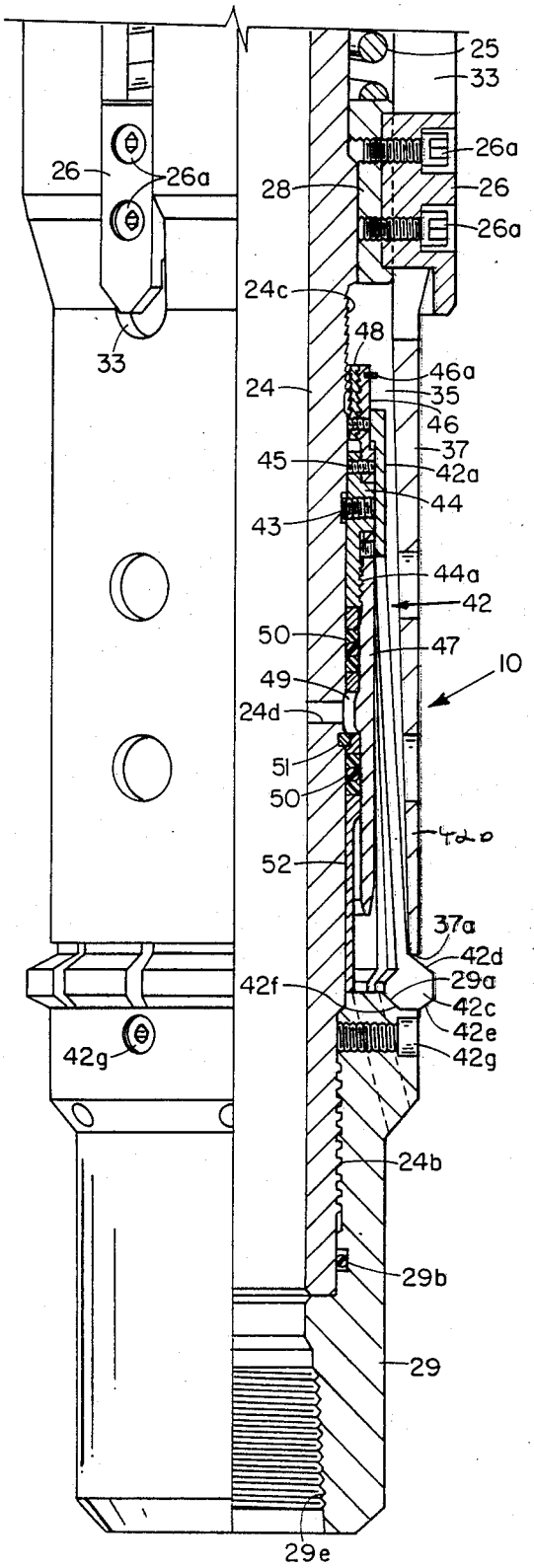

Referring now to the enlarged scale drawings of FIGS. 2A, and 2B, it will be noted that the running tool 10 embodying this invention comprises a telescopic assemblage of an inner unit 20 and an outer unit 30. Inner unit 20 has a top sub 22 having internal threads 22a for connection to the bottom end of a work string (not shown). The lower end of top sub 22 is provided with internal threads 22b which are connected to the top end of a mandrel 24 which extends downwardly through the entire length of the outer unit 30 of the tubular body assemblage 10. O-ring 22c seals threads 22b and set screw 22d secures the threads.

The outer mandrel unit 30 is further provided with a plurality of peripherally spaced, downwardly extending slots 33 which respectively slidably accommodate lugs 26. Lugs 26 are in turn secured by bolts 26a to a mounting ring 28. Mounting ring 28 is biased downwardly by a compressed spring 25.

Figure 5A:
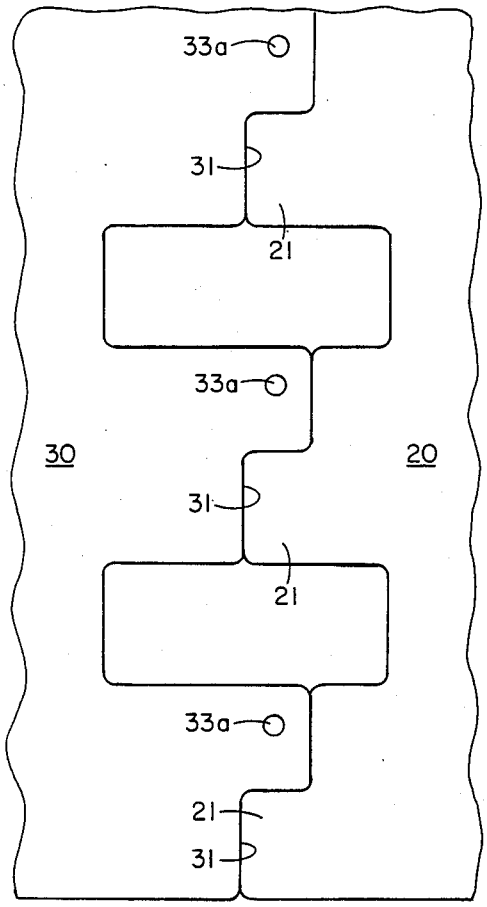
FIGS. 5A and 5B are developed views of the cooperating tongues and grooves of the inner and outer units of the running tool in their run-in and mechanical release positions respectively.
Figure 5B:
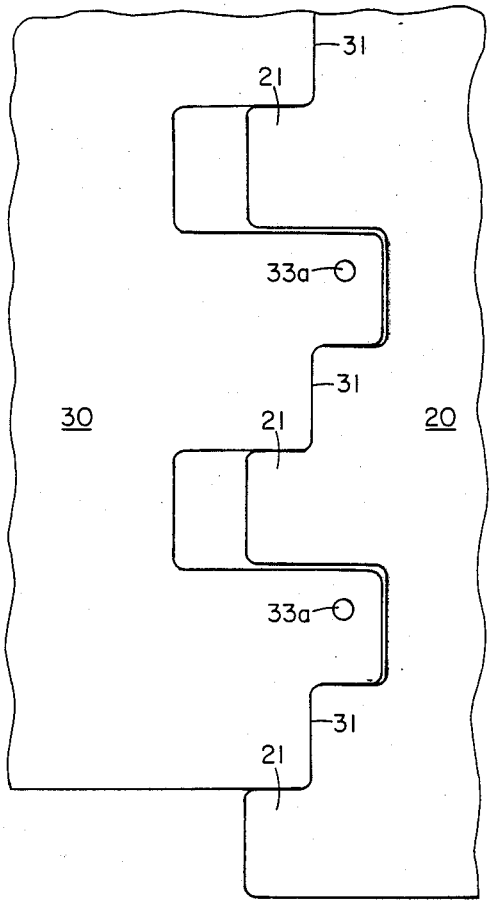

The outer unit 30 of the tubular assemblage 10 is connected for co-rotation and axial movement with the inner unit 20 by a plurality of interengaging tongues and grooves 21 and 31 respectively provided on the lower end of the inner unit 20 and the upper end of the outer unit 30. The exact configuration of these cooperating tongues and grooves is best shown in the developed view of FIG. 5A. The tongues and grooves are shearably held in interengagement by a plurality of peripherally spaced radial shear screws 33a in outer unit 30 which engage mandrel 24. It will be noted from the configuration of the cooperating tongues and grooves that limited left hand rotation of the inner unit 20 relative to the outer unit 30 is possible after shearing of the shear screws 33a. After such shearing and rotation is accomplished, the inner unit 20 and mandrel 24 can obviously be moved downwardly a limited distance relative to the outer unit 30, as shown in FIG. 5B.

The bottom ends of the slots 33 provided in the outer unit 30 to accommodate the lugs 26 terminate in a downwardly and inwardly inclined external surface 30c so that the bottom ends of lugs 26 are radially spaced from the exterior surface 30c. These units respectively cooperate with the upwardly open grooves 6b provided in the top end of the coupling sleeve 6 of the liner hanger 1 and impart rotation in either direction to the liner hanger as the tubing string is rotated. Inclined external surface 30c abuts a similarly shaped surface (not shown) on liner hanger sleeve 6 to impart setdown weight to the liner hanger if required for run-in or setting of the liner hanger The lower end of the outer unit 30 comprises a sleeve element 37 which cooperates with the external surface of mandrel 24 to define an annular chamber 35. A collet 42 is mounted in such chamber, such assemblage comprising a ring portion 42a, peripherally spaced, downwardly extending arm portions 42b, and enlarged head portions 42c at the end of such arm portions having camming surfaces 42d, 42e and 42f formed thereon. The enlarged head portions 42c normally fit within the annular groove 6a provided in the coupling sleeve 6 of the liner hanger 1 (FIG. 1A). The collet heads 42c are held in this position of engagement with the annular groove 6a by an abutment ring 29 which is threadably secured to external threads 24b provided on the bottom end of the mandrel 24 and such threads are sealed by an O-ring 29b. One or more set screw 42g effects the securement of such threads. Abutment ring 29 has an upwardly facing, inclined surface 29a engagable with the downwardly facing inclined surface 42f on the inner side of the enlarged collet heads 42c. Thus, in the run-in position of the running tool, the running tool 10 is secured for all axial movements to the liner hanger 1 by the interengagement of the enlarged collet heads 42c with the annular groove 6a.

Figure 6:
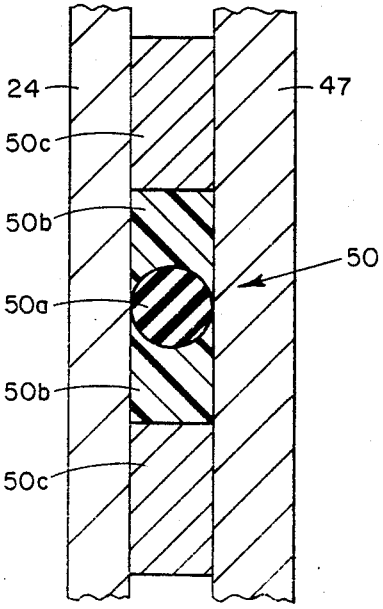
FIG. 6 is an enlarged sectional view of a piston seal unit.

The ring portion 42a of collet 42 is slidably mounted on two axially adjacent sleeves 44 and 46. The upper sleeve 46 defines the outer element of a body lock ring assemblage 48 which cooperates with wicker threads 24c formed on the mandrel 24. Upper sleeve 46 is shearably secured in abutting relationship to the lower collet supporting sleeve 44 by a shear pin 45. Lower sleeve 44 is shearably secured to the mandrel 24 by a shear pin 43. The bottom end of the collet support ring 44 is provided with external threads 44a which engage a cylinder defining sleeve 47 which is disposed in radially spaced relationship to the periphery of mandrel 24 adjacent a radial port 24d extending therethrough. Seal units 50 (FIG. 6) are mounted between the outer surface of mandrel 24 and the internal surface of the cylinder sleeve 47 to define between them a fluid pressure chamber 49. Each seal unit 50 is of identical construction, comprising a central O-ring 50*a* abutted on each side by a ring 50*b* of an extrusion resistant tetrafluorcarbon elastomer, such as that sold under the trademark "Teflon". Adjacent the other face of each Teflon unit is a metal ring 50*c*.

Figure 3B:
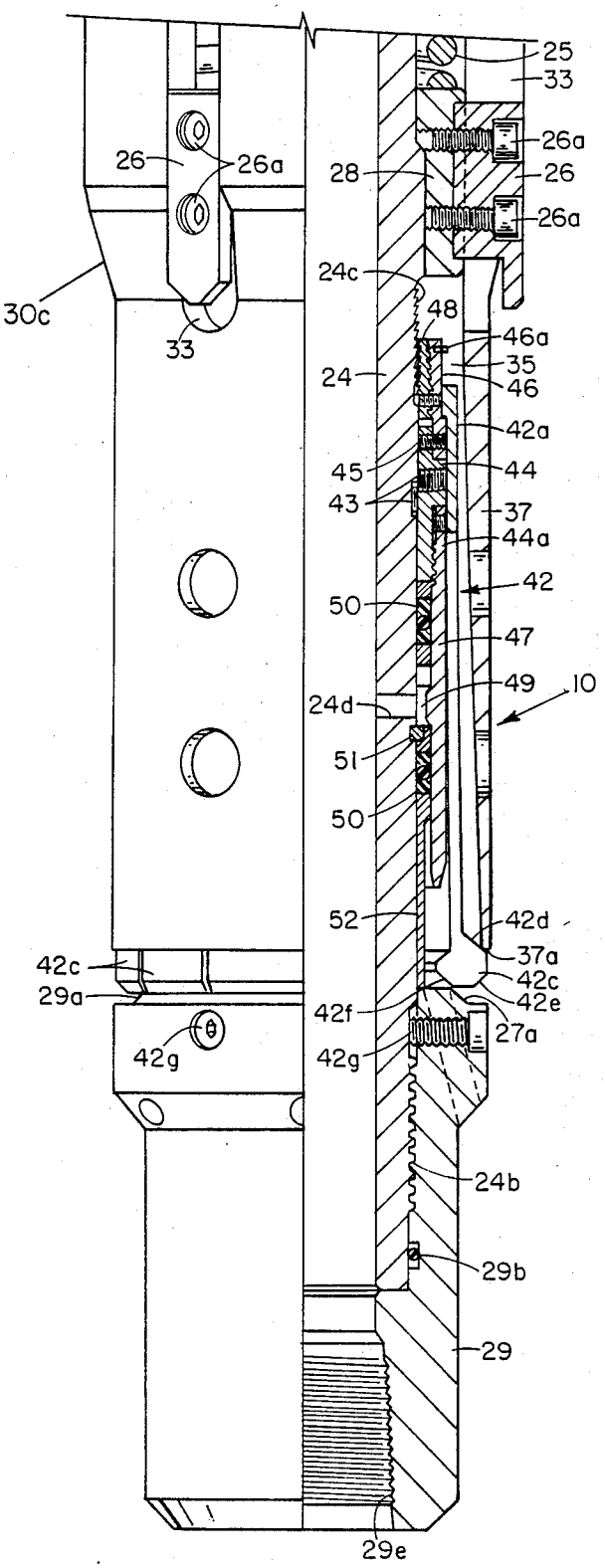
FIG. 3B corresponds to FIG. 2B but showing the running tool with the elements thereof in the positions assumed during the hydraulic release of the running tool from the liner hanger.

The lower seal unit 50 is axially secured between a C-ring 51 which cooperates with a suitable groove provided on the periphery of the mandrel 24 and a sleeve 52. The upper seal unit 50 is free to slidably and sealably move with respect to the periphery of mandrel 24 and thus, when fluid pressure is applied to the chamber 49, this seal unit functions as a piston to move upwardly and apply sufficient force to the collet support sleeve 44 to effect the shearing of shear pin 43. This permits the collet assemblage 42 to be moved upwardly, thus disengaging the enlarged collet heads 42*c* from the abutment ring 20 and permitting the collet heads 42*c* to be cammed inwardly by an upper inclined surface provided on the annular groove 6*a* in the liner hanger coupling sleeve 6, and also by the bottom end of 37*a* of outer unit 30 (FIG. 3B). As is readily apparent in FIG. 3B, the collet 42 is secured in its raised position by the cooperation of body lock ring 48 with wicker threads 24*c* on mandrel 24.

Fluid pressure may be generated within the bore of mandrel 24 by dropping a ball upon an upwardly facing seating surface (not shown) provided in such bore or provided in a supplementary sleeve secured to internal threads 29*e* provided on the bottom end of the abutment sleeve 29. Of course, the aforedescribed hydraulic release of the running tool 10 is accomplished after the setting of the liner hanger 1 so that the axial stress on the collet heads 42*c* is adjusted by the operator to be a minimum, preferably zero.

If, for any reason, the aforedescribed hydraulic release mechanism fails to function, the running tool 10 can nevertheless be released from the hanger setting tool by mechanical manipulation. The tubing string is first rotated to the left to effect the shearing of the shear pins 33*a* which hold the inner unit 20 in assemblage with outer unit 30. After the limited movement to the left of the inner unit 20 permitted by the cooperating tongues 21 and grooves 31, setdown weight can be applied to shift the inner unit 20 and mandrel 24 downwardly relative to the outer unit 30. This shifting movement effects a downward displacement of the abutment sleeve 29 relative to the enlarged collet heads 42*c* so that such collet heads are released for inward camming movement exerted by the inclined sides of the annular groove 6*a* with which they are normally engaged, as the running tool is withdrawn from the liner hanger.

Figure 4A:
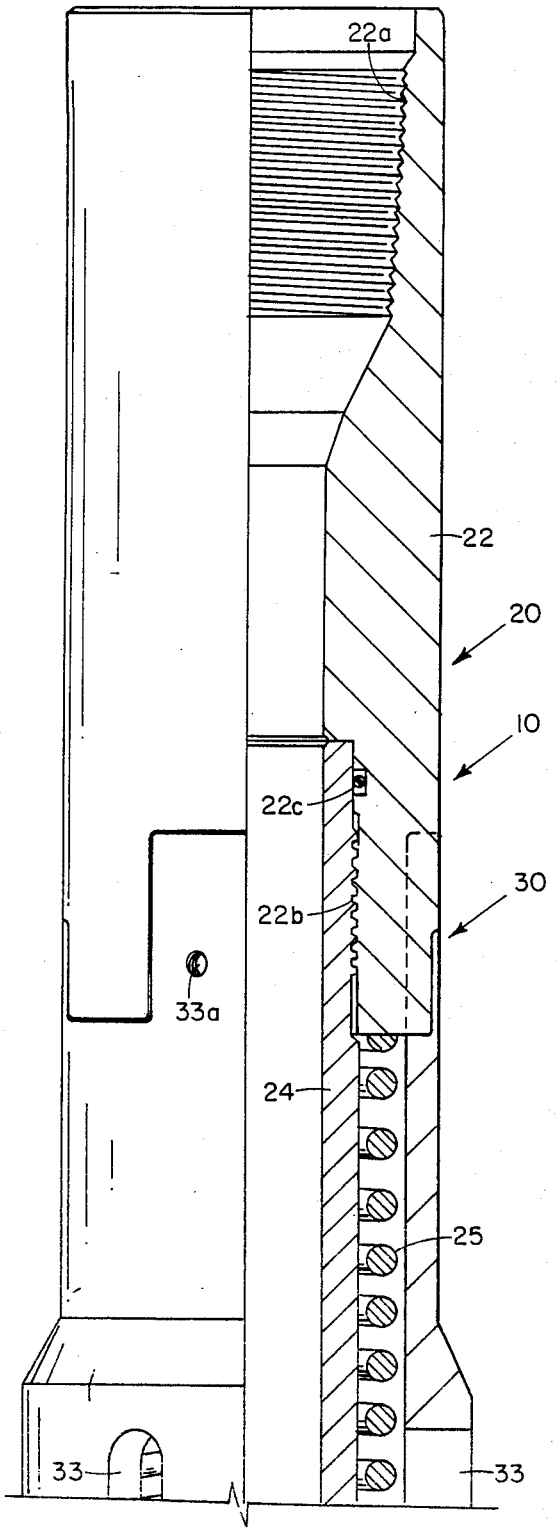
FIGS. 4A and 4B respectively correspond to FIGS. 2A and 2B but showing the position of the components of the running tool when released by mechanical manipulation of the running tool by the tubing string.
Figure 4B:
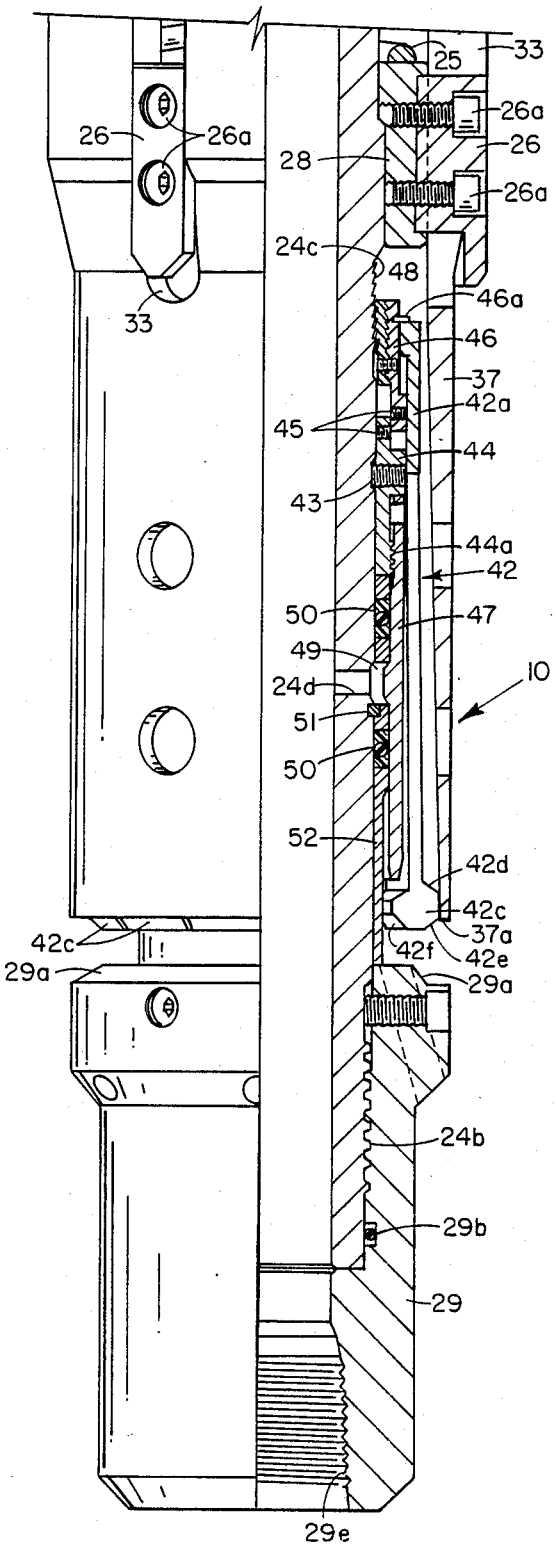

To insure that the following upward movement of the tubing string to retrieve the running tool 10 will not re-engage the collet heads 42*c* with the annular groove 6*a*, a C-ring 46*a* engages the collet ring portion 42*a* and effects the shearing of shear screws 45 to permit wicker threads 24*c* to move downwardly relative to body lock ring 48 (FIG. 4B). The downward movement of the mandrel 24 caused by the setdown weight which effects the shearing of shear pin 45 permits the collet 42 and mounting sleeve 46 to remain stationary while the mandrel 24 is moving downwardly. As a result of this relative movement, the wicker threads 24*c* on the mandrel 24 are further engaged by the body lock ring assemblage 48 and the collet 42 is permanently shifted to an upward position relative to its original run-in position, thus allowing the enlarged locking heads 42*c* to be cammed inwardly by contact with the side of the annulus groove 6*a*, so that the running tool may be completely withdrawn from the liner hanger 1.

From the foregoing description, it is readily apparent that this invention provides a simple, economically manufacturable, hydraulically actuated running tool for a liner hanger. Furthermore, in the event of failure of the hydraulic release mechanism, the running tool may be readily released from the liner hanger by mechanical manipulation of the tubing string.

Another feature of the apparatus embodying this invention is that the running tool may be re-engaged with the liner hanger after its initial release to effect rotation of the liner hanger. This operation is often required in the course of a cementing operation which follows the setting of the liner hanger. Such rotation is accomplished merely by lowering the running tool into engagement with the liner hanger and rotating the same until the downwardly projecting tongues 26 engage the respective grooves 6*b* provided in the upper end of the coupling sleeve 6 of the liner hanger.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A running tool for a liner hanger having an annular groove in its bore, and upwardly facing slots in its upper end, and a liner string depending therefrom, comprising:

a tubular body assemblage having an inner tubular unit and a telescopically related outer tubular unit;

said inner tubular unit having means for connection to a tubing string;

means for securing said inner and outer tubular units for co-rotation;

said outer tubular unit having a plurality of peripherally spaced, downwardly projecting lugs on its lower end respectively engagable with the upwardly facing slots in the liner hanger to impart rotation to the liner hanger in either direction by rotation of said inner tubular unit by the tubing string;

said inner tubular unit having a depending tubular mandrel extending through said outer tubular unit;

a collet having a ring portion and peripherally spaced, outwardly biased arm portions respectively terminating in enlarged head portions;

means for mounting said collet ring portion in axially slidable relationship to said mandrel;

shearable means for axially securing said collet to said mandrel in a run-in position wherein said enlarged heads of said collet are engaged in the annular groove of the liner hanger;

abutment means on said mandrel securing said enlarged collet heads in engagement with the liner hanger annular groove; and piston means on said mandrel responsive to fluid pressure in the bore of said mandrel for applying an axial force to said collet ring to shear said shearable means and move said enlarged collet heads axially away from said abutment means to disengage from the liner hanger annular groove.

2. The apparatus of claim 1 wherein said means for mounting said collet ring portion on said mandrel comprises:

a first sleeve slidable on said mandrel and abuttingly secured to said collet ring portion;

a second sleeve secured to said first sleeve and having a bore radially spaced from said mandrel to define an annular chamber; and said piston means comprising an annular seal assemblage slidably and sealably mounted in said annular chamber.

3. The apparatus of claim 1 further comprising means for locking said collet ring portion in the axial position to which it is shifted by said piston means.

4. The apparatus of claim 1 further comprising wicker threads on said mandrel and body lock ring means operatively connecting said collet ring portion and said wicker threads to prevent return movement of said collet from the axial position to which it is shifted by said piston means.

5. The apparatus of claim 1 wherein said piston means comprises an annular assemblage of an elastomeric O-ring, an extrusion resistant tetrafluorcarbon elastomeric ring abutting each side of said O-ring and a metal ring abutting each tetrafluorcarbon elastomer ring.

6. The apparatus of claim 1 wherein said outer tubular unit has a plurality of peripherally spaced slots respectively mounting said downwardly projecting lugs;

a support ring slidably mounted within said outer tubular body and secured to each of said downwardly projecting lugs; and a spring urging said support ring downwardly.

7. A running tool for a liner hanger having an annular groove in its bore, and upwardly facing slots in its upper end, and a liner string depending therefrom, comprising:

a tubular body assemblage having an inner tubular unit and telescopically related outer tubular unit;

said inner tubular unit having means for connection to a tubing string;

peripherally spaced, vertical tongues on one of said units;

peripherally spaced, vertical grooves on the other of said units cooperating with said tongues to prevent vertical movement of said inner tubular unit relative to said outer tubular unit until relative rotational movement of said units occurs;

first shearable means for preventing said relative rotational movement;

said outer tubular unit having a plurality of peripherally spaced, downwardly projecting lugs on its lower end respectively engagable with the upwardly facing grooves in the liner hanger to impart rotation to the liner hanger in either direction by rotation of said inner tubular unit by the tubing string;

said inner tubular unit having a depending tubular mandrel extending through said outer tubular unit;

a collet having a ring portion and peripherally spaced, outwardly biased arm portions respectively terminating in enlarged head portions;

means for mounting said collet ring portion in axially slidable relationship to said mandrel;

second shearable means for axially securing said collet to said mandrel in a run-in position wherein said enlarged heads of said collet are engaged in the annular groove of the liner hanger;

abutment means on said mandrel securing said enlarged collet heads in engagement with the liner hanger annular groove;

piston means on said mandrel responsive to fluid pressure in the bore of said mandrel for applying an axial force to said collet ring to shear said second shearable means and move said enlarged collet heads away from said abutment means to disengage from the liner hanger annular groove; and said first shearable means being shearable in an emergency by left hand rotation of said inner tubular unit, whereby subsequent downward movement of said inner tubular unit relative to said outer tubular unit will axially shift said abutment means to permit said enlarged collet heads to release from the annular groove in the liner hanger.

8. The apparatus of claim 7 wherein said means for mounting said collet ring portion on said mandrel comprises:

a first sleeve slidable on said mandrel and abuttingly secured to said collet ring portion;

a second sleeve secured to said first sleeve and having a bore radially spaced from said mandrel to define an annular chamber; and said piston means comprising an annular seal assemblage slidably and sealably mounted in said annular chamber.

9. The apparatus of claim 7 further comprising means for locking said collet ring portion in the axial position to which it is shifted by said piston means.

10. The apparatus of claim 7 further comprising wicker threads on said mandrel and body lock ring means operatively connecting said collet ring portion and said wicker threads to prevent return movement of said collet from the axial position to which it is shifted by said piston means.

11. The apparatus of claim 7 wherein said piston means comprises an annular assemblage of an elastomeric O-ring, an extrusion resistant tetrafluorcarbon elastomer ring abutting each side of said O-ring and a metal ring abutting each tetrafluorcarbon elastomer ring.

12. The apparatus of claim 7 wherein said outer tubular unit has a plurality of downwardly open slots respectively mounting said downwardly projecting lugs;

a support ring slidably mounted within said outer tubular body and secured to each of said downwardly projecting lugs; and a spring urging said support ring downwardly.

13. A running tool for a tubular well tool having an annular groove in its bore, comprising:

a tubular body assemblage having an inner tubular unit and a telescopically related outer tubular unit;

said inner tubular unit having means for connection to a tubing string;

peripherally spaced, vertical tongues on one of said units;

peripherally spaced, vertical grooves on the other of said units cooperating with said tongues to prevent downward movement of said inner tubular unit relative to said outer tubular unit until relative rotational movement of said units occurs;

shearable means for preventing said relative rotational movement;

said inner tubular unit having a depending tubular mandrel extending through said outer tubular unit;

a collet having a ring portion and peripherally spaced, outwardly biased arm portions respectively terminating in enlarged head portions;

means for mounting said collet ring portion in axially slidable relationship to said mandrel;

abutment means on said mandrel securing said enlarged collet heads in engagement with the annular groove of the well tool;

said shearable means being shearable by left hand rotation of said inner tubular unit, whereby subsequent downward movement of said inner tubular unit relative to said outer tubular unit will axially shift said abutment means to permit said enlarged collet heads to release from said annular groove in the tool.

14. The apparatus of claim 13 wherein said peripherally spaced vertical tongues and grooves have an L-shaped configuration.

15. A running tool for a tubular well tool having a latch receiving recess in its bore, comprising:

a tubular body assemblage having an inner tubular unit and a telescopically related outer tubular unit;

said inner tubular unit having means for connection to a tubing string;

peripherally spaced, vertical tongues on one of said units;

peripherally spaced, vertical grooves on the other of said units cooperating with said tongues to prevent downward movement of said inner tubular unit relative to said outer tubular unit until relative rotational movement of said units occurs;

shearable means for preventing said relative rotational movement;

said inner tubular unit having a depending mandrel extending through said outer tubular unit;

means surrounding said mandrel and having radially shiftable latch elements for engagement with the latch receiving recess of the well tool;

latch positioning means on said mandrel securing said latch means in engagement with said latch receiving recess;

said shearable means being shearable by rotation of said inner tubular unit relative to said outer tubular unit, whereby subsequent downward movement of said inner tubular unit relative to said outer tubular unit will axially shift said latch positioning means to permit said latch means to release from said latching recess in the tool.

16. The apparatus of claim 15 wherein said peripherally spaced vertical tongues and grooves have an L-shaped configuration.

* * * * *